US012024787B2

(12) United States Patent
Zhang et al.

(10) Patent No.: US 12,024,787 B2
(45) Date of Patent: Jul. 2, 2024

(54) FILLING DEVICE AND APPARATUS, ELECTROCHEMICAL DEPOSITION SYSTEM AND FILLING METHOD

(71) Applicant: BOE TECHNOLOGY GROUP CO., LTD., Beijing (CN)

(72) Inventors: Guocai Zhang, Beijing (CN); Junwei Yan, Beijing (CN); Shihao Dong, Beijing (CN); Shaodong Sun, Beijing (CN); Chengfei Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 243 days.

(21) Appl. No.: 17/514,971

(22) Filed: Oct. 29, 2021

(65) Prior Publication Data

US 2022/0290321 A1 Sep. 15, 2022

(30) Foreign Application Priority Data

Mar. 11, 2021 (CN) ..... 202120527555.7

(51) Int. Cl.
*C25D 21/14* (2006.01)
*C25D 17/00* (2006.01)

(52) U.S. Cl.
CPC ..... *C25D 21/14* (2013.01); *C25D 17/00* (2013.01)

(58) Field of Classification Search
CPC ..... C25D 21/12; C25D 21/14; C25D 17/00; C25D 17/02
See application file for complete search history.

(56) References Cited

U.S. PATENT DOCUMENTS 4,334,784 A * 6/1982 Engels ..... B28C 7/0459 366/181.4
4,805,673 A * 2/1989 Wohrle ..... B65B 1/32 141/10
4,944,334 A * 7/1990 McGregor ..... B65G 65/463 141/73
5,979,512 A * 11/1999 McGregor ..... B65B 43/30 141/10
10,207,878 B1 * 2/2019 Johnson ..... B65G 53/66
2009/0004325 A1 * 1/2009 Bacher ..... B29C 48/285 425/586

FOREIGN PATENT DOCUMENTS

JP 10291650 A * 11/1998 ..... B65G 65/46

* cited by examiner

*Primary Examiner* — Nicolas A Arnett
(74) *Attorney, Agent, or Firm* — HOUTTEMAN LAW LLC

(57) ABSTRACT

The present disclosure relates to a filling device and apparatus, an electrochemical deposition system, and a filling method. The filling device includes: a feeding structure including a first feed port and a first discharge port; a container including a second feed port and a second discharge port; a weighing means disposed on the container; a conveying structure disposed between the first discharge port and the second feed port, the second feed port being in communication with the first discharge port via the conveying structure, and the conveying structure being configured to convey a material output from the first discharge port to the second feed port; and a control structure connected to the weighing means and the conveying structure, respectively, and configured to control a conveying speed of the conveying structure according to the weight detected by the weighing means.

20 Claims, 2 Drawing Sheets

FILLING DEVICE AND APPARATUS, ELECTROCHEMICAL DEPOSITION SYSTEM AND FILLING METHOD

CROSS-REFERENCE TO RELATED APPLICATION

The present application claims priority to Chinese patent application No. 202120527555.7 filed with the China National Intellectual Property Administration on Mar. 11, 2021, the disclosure of which is incorporated herein by reference in its entirety.

TECHNICAL FIELD

The present disclosure relates to the field of manufacturing of display products, and particularly relates to a filling device and apparatus, an electrochemical deposition system and a filling method.

BACKGROUND

The electrochemical deposition process is a low-cost chemical film forming mode that can deposit a low-resistance metal layer with a thickness of 2 to 20 μm. The electrochemical deposition process refers to a process of obtaining a metal coating on a substrate through migration of positive and negative ions in an electrolyte solution containing metal ions under the action of an external electric field, and through reduction of metal ions at a cathode.

SUMMARY

The present disclosure provides a filling device and apparatus, an electrochemical deposition system and a filling method.

In one aspect, the present disclosure provides a filling device, including:

a feeding structure including a first feed port and a first discharge port;

a container including a second feed port and a second discharge port, the second discharge port serving as a discharge port of the filling device;

a weighing means disposed on the container, the weighing means being configured to detect a weight of a material in the container;

a conveying structure disposed between the first discharge port and the second feed port, the second feed port being in communication with the first discharge port via the conveying structure, and the conveying structure being configured to convey a material output from the first discharge port to the second feed port; and a control structure connected to the weighing means and the conveying structure, respectively, and configured to control a conveying speed of the conveying structure according to the weight detected by the weighing means.

In some embodiments, the conveying structure includes:

a conveying pipeline connected between the first discharge port and the second feed port; and a spiral member disposed in the conveying pipeline, the spiral member including a rotation shaft and spiral blades arranged on the rotation shaft; and wherein the control structure is connected to the rotation shaft and controls the conveying speed of the conveying structure by controlling a speed of the rotation shaft.

In some embodiments, the control structure includes a controller and a driver, wherein the controller is coupled with the weighing means and configured to send a control signal to the driver based on the weight detected by the weighing means; and the driver is connected to the rotation shaft and configured to control a rotation speed of the rotation shaft according to the control signal.

In some embodiments, the control structure is specifically configured to, when the weight detected by the weighing means is less than or equal to b times of a target weight, control the conveying structure to convey a material at a first speed; when the weight detected by the weighing means is greater than b times of the target weight and less than the target weight, control the conveying structure to convey a material at a second speed; and when the weight detected by the weighing means reaches the target weight, control the conveying structure to stop conveying of the material; and wherein $0<b<1$, and the first speed is greater than the second speed.

In some embodiments, the container is further provided with a second valve, the control structure is connected to the second valve, and the control structure is further configured to, control the second valve to remain closed when the material entering the accommodation bin; control the second valve to remain closed when the weight of the material detected by the weighing means does not reach the target weight; and control the second valve to open to form the second discharge port when the weight detected by the weighing means reaches the target weight.

In some embodiments, the feeding structure includes:

a feeder including a feeder feed port and a feeder discharge port, the feeder feed port serving as the first feed port;

a buffer bin including a buffer bin feed port and a buffer bin discharge port, the buffer bin feed port being in communication with the feeder discharge port, and the buffer bin discharge port serving as the first discharge port; and a first valve provided on the feeder and configured to control a material quantity output from the feeder to the buffer bin.

In some embodiments, the filling device further includes: a bracket on which the container and the feeding structure are provided.

In some embodiments, the filling device further includes: a display means coupled with the weighing means and configured to display the weight detected by the weighing means.

In another aspect, an embodiment of the present disclosure further provides a filling apparatus, including: a supply source and the filling device as described above, the supply source being in communication with the first feed port of the feeding structure.

In another aspect, an embodiment of the present disclosure further provides an electrochemical deposition system, including an electrochemical deposition apparatus and the filling apparatus as described above.

In some embodiments, the electrochemical deposition system further includes a dissolution device, the dissolution device is connected to the second discharge port and the electrochemical deposition apparatus, respectively, and the material output from the second discharge port is discharged to the dissolution device to form an electrochemical deposition liquid with a target concentration, and the electrochemical deposition liquid is discharged from the dissolution device to the electrochemical deposition apparatus.

In some embodiments, the material is copper oxide powder, and the electrochemical deposition liquid has a target concentration of copper ions.

In another aspect, an embodiment of the present disclosure further provides a filling method performing filling with the filling device as describe above and including the steps of:

controlling, by the control structure, the conveying structure so that the material is conveyed from the first discharge port of the feeding structure to the second feed port of the container through the conveying structure;

detecting, by the weighing means, the weight of the material in the container;

controlling, by the control structure, a conveying speed of the conveying structure according to the weight detected by the weighing means so that when the material in the container is less than a target weight, the control structure controls the conveying speed of the conveying structure to be greater than 0; and when the material in the container reaches the target weight, the control structure controls the conveying speed of the conveying structure to be equal to 0; and outputting the material from the second discharge port of the container.

In some embodiments, the filling method further includes the step of: controlling, by the control structure, the conveying speed of the conveying structure by controlling a speed of the rotation shaft.

In some embodiments, the filling method further includes the steps of: sending, by the controller, a control signal to the driver based on the weight detected by the weighing means; and controlling, by the driver, a rotation speed of the rotation shaft according to the control signal.

In some embodiments, the step of controlling, by the control structure, the conveying speed of the conveying structure includes:

controlling, by the controller when the weight detected by the weighing means is less than or equal to b times of a target weight, the conveying structure to convey a material at a first speed;

controlling, by the controller when the weight detected by the weighing means is greater than b times of the target weight and less than the target weight, the conveying structure to convey a material at a second speed; and controlling, by the controller when the weight detected by the weighing means reaches the target weight, the conveying structure to stop conveying of the material; and wherein $0<b<1$, and the first speed is greater than the second speed.

In some embodiments, the filling method further includes the steps of:

controlling, by the control structure, the second valve to remain closed when the weight of the material detected by the weighing means does not reach the target weight; and controlling, by the control structure, the second valve to open to form the second discharge port when the weight detected by the weighing means reaches the target weight.

In some embodiments, the filling method further includes the step of: controlling, by the first valve, a material quantity output from the feeder to the buffer bin.

In some embodiments, the first feed port of the feeding structure is in communication with a supply source, and the filling method further includes the step of: conveying a material from the supply source to the first feed port of the feeding structure.

In some embodiments, the second discharge port of the container is in communication with the electrochemical deposition system, and the filling method further includes the step of: discharging the material output from the second discharge port into the electrochemical deposition system.

BRIEF DESCRIPTION OF THE DRAWINGS

Accompanying drawings are provided for further understanding of this disclosure and constitute a part of the specification. Hereinafter, these drawings are intended to explain the disclosure together with the following specific embodiments, but should not be considered as a limitation of the disclosure. In the drawings.

DETAILED DESCRIPTION

Figure 1:
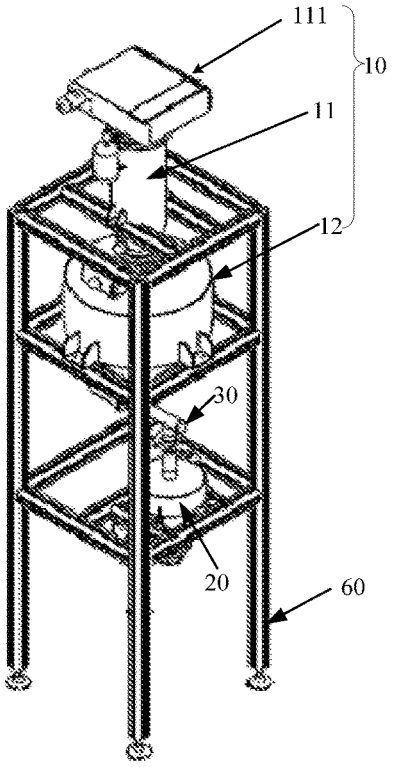
FIG. 1 is a perspective view illustrating a partial structure of a filling device provided in some embodiments of the present disclosure.

Hereinafter, specific embodiments of the present disclosure will be described with respect to the accompanying drawings. It will be appreciated that the specific embodiments as set forth herein are merely for the purpose of illustration and explanation of the disclosure and should not be constructed as a limitation thereof.

Unless otherwise defined, technical or scientific terms used in the embodiments of the present disclosure are intended to have general meanings as understood by those of ordinary skill in the art. The words "first", "second" and similar terms used in the present disclosure do not denote any order, quantity, or importance, but are used merely for distinguishing different components. Similarly, the word "comprising" or "comprises" or the like means that the element or item preceding the word includes elements or items that appear after the word or equivalents thereof, but does not exclude other elements or items. The terms "connected" or "coupled" and the like are not restricted to physical or mechanical connections, but may include electrical connections, whether direct or indirect. The words "upper", "lower", "left", "right", or the like are merely used to indicate a relative positional relationship, and when an absolute position of the described object is changed, the relative positional relationship may also be changed accordingly.

In the display field, especially in the LED display field (including MiniLED/micro LED), the current of LED is in the order of several tens of milliamperes. Thereby, a metal coating with high current-carrying capacity, such as a thick copper film layer, is required. Taking the copper film layer as an example, when a copper film layer is required, a copper film layer with a thickness of less than 2 μm may be deposited on a substrate by sputter deposition, while a copper film layer with a thickness of more than 2 μm needs to be deposited on the substrate by an electrochemical deposition method from the viewpoint of efficiency and cost. Therefore, when a thicker copper film layer is deposited on the substrate, the efficiency can be improved and the cost can be reduced by adopting the electrochemical deposition method.

During implementation of the electrochemical deposition process, a substrate to be processed is loaded on a carrier and placed in a reaction tank of an electrochemical deposition apparatus. The reaction tank contains an electrolyte solution with metal ions. An anode structure of the electrochemical deposition apparatus is connected to a positive output of a power supply, while the carrier is connected to a negative output of the power supply so that an electric field is formed between the anode structure and the substrate. Under the action of the electric field, positive and negative ions in the electrolyte solution migrate so that a metal coating is obtained on the substrate. In some embodiments, when the metal ions in the electrolyte solution are copper ions, the obtained metal coating is a copper film layer.

In an electrochemical deposition process, the ion balance in the electrolyte solution affects the deposition effect of the film layer. As the electrochemical deposition process proceeds, a content of metal ions in the electrolyte solution will also gradually decrease. Therefore, the metal ions need to be supplemented in time when the content of metal ions in the electrolyte solution is lower, and the supplemented amount of metal ions should be accurately controlled.

Figure 2:
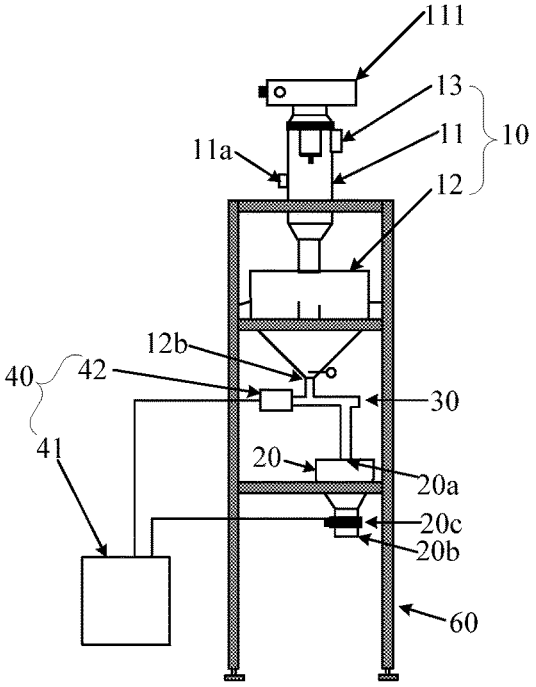
FIG. 2 is a side view of a filling device provided in some embodiments of the present disclosure.

FIG. 1 is a perspective view illustrating a partial structure of a filling device provided in some embodiments of the present disclosure, and FIG. 2 is a side view of a filling device provided in some embodiments of the present disclosure. The filling device is configured to supplement materials into the reaction tank of the electrochemical deposition apparatus. The material is powder. In some embodiments, the electrochemical deposition apparatus is configured to deposit a metal film layer on a substrate, the material supplemented by the filling device may be a metal oxide powder, and the metal ions in the metal oxide are the same as those in the electrolyte solution in the reaction tank. In some embodiments, the metal ions in the electrolyte solution in the reaction tank are copper ions, and thus the metal oxide powder is copper oxide powder.

As shown in FIGS. 1 and 2, the filling device includes: a feeding structure 10, a container 20, a weighing means (not shown), a conveying structure 30 and a control structure 40. The feeding structure 10 includes a first feed port 11*a* and a first discharge port 12*b*. In some embodiments, the first feed port 11*a* is in communication with a supply source of materials that may convey a material to the first feed port 11*a*. In some embodiments, the container 20 is an accommodation bin.

The container 20 includes a second feed port 20*a* and a second discharge port 20*b*. The second feed port 20*a* is in communication with the first discharge port 12*b*, and the second discharge port 20*b* serves as a discharge port of the filling device. In some embodiments, the second feed port 20*a* is located at a top of the container 20, and the second discharge port 20*b* is located at a bottom of the container 20. In some embodiments, the container 20 may have a funnel shape so that the material can smoothly slide down to the second discharge port 20*b* after entering the container 20 from the second feed port 20*a*.

The weighing means is disposed on the container 20, and is configured to detect a weight of a material in the container 20. In some embodiments, the weighing means is disposed at the bottom of the container 20. In some embodiments, the weighing means may use a pressure sensor or the like.

In some embodiments, the bottom of the container 20 may be a plate-like structure.

In some embodiments, the plate-like structure and sidewalls of the container 20 may contact each other to collaboratively form a closed box-like space, and may be rotated relative to each other to effect partial separation of the plate-like structure and the sidewalls. When the material weight detected by the weighing means reaches a target weight, the control structure 40 may control the plate-like structure to be separated from at least a portion of the sidewalls of the container 20, thereby forming the second discharge port 20*b* from which the material in the container 20 may be output.

In some embodiments, a partial region in the plate-like structure may be movable. When the material weight detected by the weighing means reaches the target weight, the control structure 40 may control the partial region of the plate-like structure to move, thereby forming the second discharge port 20*b* from which the material in the container 20 may be output.

In some embodiments, the material output from the second discharge port 20*b* is discharged into the electrochemical deposition system.

In this context, the target weight refers to a weight of the material to be output by the filling device. In some embodiments, the target weight is a weight of the material that the filling device needs to supplement into the electrochemical deposition apparatus.

The conveying structure 30 is disposed between the first discharge port 12*b* and the second feed port 20*a*. The second feed port 20*a* is in communication with the first discharge port 12*b* via the conveying structure 30. The conveying structure 30 is configured to convey a material output from the first discharge port 12*b* to the second feed port 20*a*.

The control structure 40 is connected to the weighing means and the conveying structure 30, respectively. The control structure 40 is configured to control a conveying speed of the conveying structure 30 according to the weight detected by the weighing means.

In an embodiment of the present disclosure, the control structure 40 may control a conveying speed of the conveying structure 30 according to the weight detected by the weighing means. When the material in the container 20 is less than the target weight, the control structure 40 controls the conveying speed of the conveying structure 30 to be greater than 0; and when the material in the container 20 reaches the target weight, the control structure 40 controls the conveying speed of the conveying structure 30 to be equal to 0 (i.e., to stop material conveying). In this manner, the weight of the material entering the container 20 can be accurately controlled by means of the control structure 40, so that the weight of the material put into the electrochemical deposition apparatus can be accurately controlled, which is favorable for realizing the balance of metal ions in the electrolyte solution.

In some embodiments, the control structure 40 is specifically configured to, when the weight detected by the weighing means is less than or equal to b times of a target weight, control the conveying structure 30 to convey a material at a first speed; when the weight detected by the weighing means is greater than b times of the target weight and less than the target weight, control the conveying structure 30 to convey a material at a second speed; and when the weight detected by the weighing means reaches the target weight, control the conveying structure 30 to stop conveying of the material. In the above embodiment, $0<b<1$, and the first speed is greater than the second speed. In some embodiments, b may be 0.6.

Therefore, when the material in the container 20 has a weight much less than the target weight, the control structure 40 controls the conveying structure 30 to convey the material at a higher speed, thereby increasing the material conveying speed and improving the efficiency. When the material in the container 20 approaches the target weight, the control structure 40 controls the conveying structure 30 to convey the material at a lower speed, thereby facilitating accuracy control of the material. When the material in the container 20 reaches the target weight, the control structure 40 controls the conveying speed of the conveying structure 30 to be 0, i.e., to stop material conveying. When the weight of the material in the container 20 reaches the target weight, the material in the container 20 is discharged into a subsequent apparatus (for example, the metal oxide powder is discharged into an electrochemical deposition apparatus to supplement metal ions into an electrolyte solution). In this way, the weight of the material entering the container 20 can be more accurately controlled by means of the control structure 40, which is favorable for realizing the balance of metal ions in the electrolyte solution.

It should be noted that the second discharge port 20*b* of the container 20 remains in a closed state while the material entering the container 20. Specifically, the container 20 is provided with a second valve 20*c* connected to the control structure 40. The control structure 40 is further configured to, when the weight detected by the weighing means reaches the target weight, control the second valve 20*c* to open so that the material is output from the container 20. In some embodiments, the bottom of the container 20 may be a plate-like structure. The plate-like structure and sidewalls of the container 20 may contact each other to collaboratively form a closed space, and may be rotated relative to each other to effect partial separation of the two. In some other embodiments, a partial region in the plate-like structure may be movable. When the material weight detected by the weighing means does not reach a target weight, the second valve 20*c* remains closed, and the control structure 40 controls the plate-like structure to be in close contact with the sidewalls of the container 20, so that the container forms a closed box-like space to prevent the material from falling off. When the material weight detected by the weighing means reaches a target weight, the control structure 40 controls the second valve 20*c* to open so that the plate-like structure is separated from at least a portion of the sidewalls of the container 20 (or so that the partial region of the plate-like structure is moved), thereby forming the second discharge port 20*b* from which the material in the container 20 may be output. In some embodiments, the second valve 20*c* may be implemented by one of or a combination of: a hinges, a fastener, an electromagnetic fastener, a knob fastener, a MEMS (Micro Electro Mechanical System), and the like.

In some embodiments, the filling device further includes a display means (not shown) connected to the weighing means. The display means is configured to display the weight detected by the weighing means to prompt an operator. In some embodiments, the display means may include a display screen.

In some embodiments, as shown in FIGS. 1 and 2, the filling device further includes a bracket 60. The container 20 and the feeding structure 10 are both provided on the bracket 60, and the feeding structure 10 is located above the container 20. In some embodiments, to improve the support stability of the bracket 60, the bracket 60 may be made of stainless steel.

In some embodiments, as shown in FIG. 2, the feeding structure 10 includes: a feeder 11, a buffer bin 12 and a first valve 13 disposed on the feeder 11.

A feed port of the feeder 11 serves as the first feed port 11*a*. In some embodiments, the feeder 11 may be a vacuum feeder 11. The vacuum feeder 11 includes: a machine body with a feed port, a discharge port and a vent. The feed port of the vacuum feeder 11 is connected to a supply source, and the vent is in communication with a vacuum generator 111 (e.g., a VAH-6000 model vacuum generator). The vacuum generator 111 generates a negative pressure in the feeder 11 so that the material supplied from the supply source is sucked into the machine body.

In some embodiments, the supply source may include a supply bin and a supply pipeline. The supply bin is provided with a dispense port having a bin door and a supply port. When the bin door is opened, the material is dispensed into the supply bin from the dispense port. Since the supply port is in communication with the feed port of the feeder 11 through the supply pipeline, and is disposed on a bottom of the supply bin, the material in the supply bin enters the supply port under the action of gravity. In some embodiments, the supply bin may be further provided with a power structure configured to drive the material in the supply bin into the supply pipeline. When the vacuum generator 111 generates a negative pressure in the feeder 11, the material in the supply bin is conveyed to the feeder 11 through the supply pipeline. In some embodiments, the supply bin may be further provided with a fan and a filter at the top. The fan is configured to suck air from the supply bin and blow material dust scattering in the container to the filter. The filter is configured to adsorb material dust. In this way, the material dust can be prevented from scattering to an outside operation room when the bin door is opened.

A feed port of the buffer bin 12 is in communication with the discharge port of the feeder 11. The discharge port of the buffer bin 12 serves as the first discharge port 12*b*, and thus is connected to the conveying structure 30. Optionally, the buffer bin 12 may have a funnel-like structure. In some embodiments, an upper half of the buffer bin 12 is a cylindrical structure, while a lower half thereof is an inverted conical structure. The first discharge port 12*b* is disposed at the bottom of the buffer bin 12, so as to facilitate output of the material in the buffer bin 12 from the first discharge port 12*b*. In some embodiments, the buffer bin 12 may have other shapes, as long as it facilitates output of the material from the first discharge port 12*b*.

The first valve 13 is configured to control a material quantity output from the feeder 11 to the buffer bin 12 (the material quantity here refers to the weight of the material). For example, the first valve 13 may be closed before the material is added to the buffer bin 12, and then may be opened after the material is added to the buffer bin 12. In some embodiments, the first valve 13 may be a solenoid valve.

Figure 3:
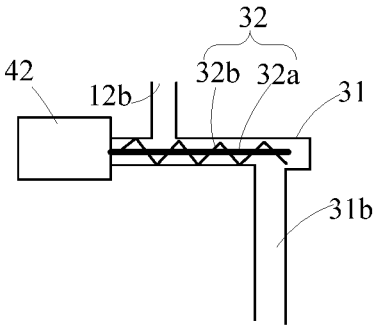
FIG. 3 is a schematic diagram of a conveying structure and a driver provided in some embodiments of the present disclosure.

FIG. 3 is a schematic diagram of a conveying structure and a driver provided in some embodiments of the present disclosure. As shown in FIGS. 2 and 3, in some embodiments, the conveying structure 30 may include: a conveying pipeline 31 and a spiral member 32 disposed in the conveying pipeline 31. A feed port of the conveying pipeline 31 is in communication with the first discharge port 12*b*, and a discharge port 31*b* of the conveying pipeline 31 is in communication with the second feed port 20*a*. The spiral member 32 includes: a rotation shaft 32*a* and spiral blades 32*b* provided on the rotation shaft 32*a*. When the rotation shaft 32*a* is rotated, the spiral blades 32*b* drive the material in the conveying pipeline 31 to be conveyed to the discharge port of the conveying pipeline 31. The control structure 40 is connected to the rotation shaft 32*a* and controls the conveying speed of the conveying structure 30 by controlling a speed of the rotation shaft 32*a*. In some embodiments, as shown in FIG. 2, the control structure 40 may include: a controller 41 and a driver 42. The controller 41 is coupled with the weighing means and configured to send a control signal to the driver 42 based on the weight detected by the weighing means. The driver 42 is configured to control a rotation speed of the rotation shaft 32*a* according to the control signal. In some embodiments, the driver 42 may be a servo motor.

In some embodiments, when the weight detected by the weighing means is less than or equal to b times of a target weight, the controller 41 sends a first control signal, and the driver 42 drives the rotation shaft 32*a* to rotate at a higher speed according to the first control signal, so that the material in the conveying pipeline 31 is conveyed at the first speed. When the weight detected by the weighing means is greater than b times of the target weight and less than the target weight, the controller 41 sends a second control signal, and the driver 42 drives the rotation shaft 32*a* to rotate at a lower speed according to the second control signal, so that the material in the conveying pipeline 31 is conveyed at the second speed. When the weight detected by the weighing means equals to the target weight, the controller 41 sends a third control signal, and the driver 42 drives the rotation shaft 32*a* to stop rotation according to the third control signal, so that conveying of the material in the conveying pipeline 31 is stopped. In the above embodiment, $0<b<1$, and the first speed is greater than the second speed.

It should be noted that the conveying structure 30 may also adopt other structures. In some embodiments, the conveying structure 30 includes a conveying pipeline 31 and a valve disposed on the conveying pipeline 31. The material in the conveying pipeline 31 is conveyed toward the container 20 by gravity. The control structure 40 controls a degree of opening of the valve on the conveying pipeline 31, and thus controls the conveying speed of the material in the conveying pipeline 31.

In some embodiments, a target weight of material to be supplemented into the electrochemical deposition apparatus is 0.5 kg. First, the control structure 40 controls the conveying structure 30 to stop the material conveying, and the feeder 11 adds the material of more than the target weight into the buffer bin 12 (for example, 2 kg of the material is added into the buffer bin 12). Then, control structure 40 controls the conveying structure 30 to convey, and the weighing means on the container 20 detects the weight of the material in the container 20 in real time. The conveying structure 30 begins conveying of the material at a higher speed. When the weight of the material in the container 20 reaches 0.3 kg, the control structure 40 controls the conveying structure 30 to convey the material at a lower speed. When the weight of the material in the container 20 reaches 0.5 kg, the control structure 40 controls the conveying structure 30 to stop conveying. Afterwards, the material in the container 20 is discharged into the electrochemical deposition apparatus. When the material needs to be supplemented into the electrochemical deposition apparatus again, the conveying structure 30 may be directly controlled to convey the material because there is still sufficient material in the buffer bin 12. In some embodiments, the buffer bin 12 may further include an additional weighing means to supplement the material in time when there is insufficient material in the buffer bin 12.

An embodiment of the present disclosure further provides an electrochemical deposition system, including an electrochemical deposition apparatus for performing an electrochemical deposition process, and further including the filling apparatus according to the above embodiments for supplying a material to the electrochemical deposition apparatus.

In some embodiments, the electrochemical deposition system further includes a dissolution device. The dissolution device is connected to the second discharge port and the electrochemical deposition apparatus, respectively. The material output from the second discharge port is discharged to the dissolution device to form an electrochemical deposition liquid with a target concentration. The electrochemical deposition liquid is discharged from the dissolution device to the electrochemical deposition apparatus. In some embodiments, the material is copper oxide powder, and the electrochemical deposition liquid has a target concentration of copper ions. It should be noted that the target concentration of copper ions refers to a concentration of copper ions in the electrochemical deposition liquid to be maintained in the reaction tank of the electrochemical deposition apparatus.

An embodiment of the present disclosure further provides a filling method further, including the step of: controlling, by the control structure 40, the conveying structure 30 so that the material is conveyed from the first discharge port 12*b* of the feeding structure 10 to the second feed port 20*a* of the container 20 through the conveying structure 30; detecting, by the weighing means, the weight of the material in the container 20; controlling, by the control structure 40, a conveying speed of the conveying structure 30 according to the weight detected by the weighing means so that when the material in the container is less than the target weight, the control structure 40 controls the conveying speed of the conveying structure 30 to be greater than 0; and when the material in the container 20 reaches the target weight, the control structure 40 controls the conveying speed of the conveying structure 30 to be equal to 0; and outputting the material from the second discharge port 20*b* of the container 20. In the present disclosure, the filling device can accurately control the weight of the material put into the electrochemical deposition apparatus, which is favorable for realizing the balance of metal ions in the electrolyte solution and thus improves the film forming effect of the electrochemical deposition apparatus.

It will be appreciated that the above implementations are merely exemplary embodiments for the purpose of illustrating the principle of the disclosure, and the disclosure is not limited thereto. Various modifications and improvements can be made by a person having ordinary skill in the art without departing from the spirit and essence of the disclosure. Accordingly, all of the modifications and improvements also fall into the protection scope of the disclosure.

What is claimed is:

1. An electrochemical deposition system, comprising an electrochemical deposition apparatus and a filling device, wherein the filling device comprises:

a feeding structure comprising a first feed port and a first discharge port;

a container comprising a second feed port and a second discharge port, the second discharge port serving as a discharge port of the filling device, the second discharge port of the container is in communication with the electrochemical deposition apparatus;

a weighing component disposed on the container, the weighing component being configured to detect a weight of a material in the container;

a conveying structure disposed between the first discharge port and the second feed port, the second feed port being in communication with the first discharge port via the conveying structure, and the conveying structure being configured to convey a material output from the first discharge port to the second feed port; and a control structure connected to the weighing component and the conveying structure, respectively, and configured to control a conveying speed of the conveying structure according to the weight detected by the weighing component.

2. The electrochemical deposition system according to claim 1, wherein the conveying structure comprises:

a conveying pipeline connected between the first discharge port and the second feed port; and a spiral member disposed in the conveying pipeline, the spiral member comprising a rotation shaft and spiral blades arranged on the rotation shaft; and wherein the control structure is connected to the rotation shaft and controls the conveying speed of the conveying structure by controlling a speed of the rotation shaft.

3. The electrochemical deposition system according to claim 2, wherein the control structure comprises a controller and a driver, wherein the controller is coupled with the weighing component and configured to send a control signal to the driver based on the weight detected by the weighing component; and the driver is connected to the rotation shaft and configured to control a rotation speed of the rotation shaft according to the control signal.

4. The electrochemical deposition system according to claim 1, wherein the control structure is configured to, when the weight detected by the weighing component is less than or equal to b times of a target weight, control the conveying structure to convey a material at a first speed;

when the weight detected by the weighing component is greater than b times of the target weight and less than the target weight, control the conveying structure to convey a material at a second speed; and when the weight detected by the weighing component reaches the target weight, control the conveying structure to stop conveying of the material; and wherein $0<b<1$, and the first speed is greater than the second speed.

5. The electrochemical deposition system according to claim 4, wherein the container is further provided with a second valve, the control structure is connected to the second valve, and the control structure is further configured to, control the second valve to remain close when the material entering the container; control the second valve to remain closed when the weight of the material detected by the weighing component does not reach the target weight; and control the second valve to open to form the second discharge port when the weight detected by the weighing component reaches the target weight.

6. The electrochemical deposition system according to claim 1, wherein the feeding structure comprises:

a feeder comprising a feeder feed port and a feeder discharge port, the feeder feed port serving as the first feed port;

a buffer bin comprising a buffer bin feed port and a buffer bin discharge port, the buffer bin feed port being in communication with the feeder discharge port, and the buffer bin discharge port serving as the first discharge port; and a first valve provided on the feeder and configured to control a material quantity output from the feeder to the buffer bin.

7. The electrochemical deposition system according to claim 1, wherein the filling device further comprises: a bracket on which the container and the feeding structure are provided.

8. The electrochemical deposition system according to claim 1, wherein the filling device further comprises:

a display component coupled with the weighing component and configured to display the weight detected by the weighing component.

9. The electrochemical deposition system according to claim 1, comprising: a supply source, the supply source being in communication with the first feed port of the feeding structure.

10. The electrochemical deposition system according to claim 1, wherein the electrochemical deposition system further comprises a dissolution device, the dissolution device is connected to the second discharge port and the electrochemical deposition apparatus, respectively, and the material output from the second discharge port is discharged to the dissolution device to form an electrochemical deposition liquid with a target concentration, and the electrochemical deposition liquid is discharged from the dissolution device to the electrochemical deposition apparatus.

11. The electrochemical deposition system according to claim 10, wherein the material is copper oxide powder, and the electrochemical deposition liquid has a target concentration of copper ions.

12. A filling method for an electrochemical deposition system according to claim 1, wherein the electrochemical deposition system comprises an electrochemical deposition apparatus and a filling device, wherein the filling device comprises:

a feeding structure comprising a first feed port and a first discharge port;

a container comprising a second feed port and a second discharge port, the second discharge port serving as a discharge port of the filling device, the second discharge port of the container is in communication with the electrochemical deposition apparatus;

a weighing component disposed on the container, the weighing component being configured to detect a weight of a material in the container;

a conveying structure disposed between the first discharge port and the second feed port, the second feed port being in communication with the first discharge port via the conveying structure, and the conveying structure being configured to convey a material output from the first discharge port to the second feed port; and a control structure connected to the weighing component and the conveying structure, respectively, and configured to control a conveying speed of the conveying structure according to the weight detected by the weighing component, the filling method performs filling with the filling device and comprises:

controlling, by the control structure, the conveying structure so that the material is conveyed from the first discharge port of the feeding structure to the second feed port of the container through the conveying structure;

detecting, by the weighing component, the weight of the material in the container;

controlling, by the control structure, a conveying speed of the conveying structure according to the weight detected by the weighing component, when the material in the container is less than a target weight, the control structure controls the conveying speed of the conveying structure to be greater than 0; and when the material in the container reaches the target weight, the control structure controls the conveying speed of the conveying structure to be equal to 0; and outputting the material from the second discharge port of the container.

13. The filling method according to claim 12, wherein the conveying structure comprises a conveying pipeline and a spiral member, the conveying pipeline is connected between the first discharge port and the second feed port; the spiral member is disposed in the conveying pipeline and comprises a rotation shaft connected with the control structure and spiral blades arranged on the rotation shaft, wherein the filling method further comprises:

controlling, by the control structure, the conveying speed of the conveying structure by controlling a speed of the rotation shaft.

14. The filling method according to claim 13, wherein the control structure comprises a controller and a driver, the controller is coupled with the weighing component, and the driver is connected to the rotation shaft, wherein the filling method further comprises:

sending, by the controller, a control signal to the driver based on the weight detected by the weighing component; and controlling, by the driver, a rotation speed of the rotation shaft according to the control signal.

15. The filling method according to claim 12, wherein controlling, by the control structure, the conveying speed of the conveying structure comprises:

controlling, by the controller when the weight detected by the weighing component is less than or equal to b times of a target weight, the conveying structure to convey a material at a first speed;

controlling, by the controller when the weight detected by the weighing component is greater than b times of the target weight and less than the target weight, the conveying structure to convey a material at a second speed; and controlling, by the controller when the weight detected by the weighing component reaches the target weight, the conveying structure to stop conveying of the material; and wherein $0<b<1$, and the first speed is greater than the second speed.

16. The filling method according to claim 15, wherein the container is further provided with a second valve, the control structure is connected to the second valve, and the filling method further comprises:

controlling, by the control structure, the second valve to remain closed when the weight of the material detected by the weighing component does not reach the target weight; and controlling, by the control structure, the second valve to open to form the second discharge port when the weight detected by the weighing component reaches the target weight.

17. The filling method according to claim 12, wherein the feeding structure comprises a feeder, a buffer bin and a first valve, the feeder comprises a feeder feed port and a feeder discharge port, the feeder feed port serving as the first feed port, the buffer bin comprises a buffer bin feed port and a buffer bin discharge port, the buffer bin feed port being in communication with the feeder discharge port, and the buffer bin discharge port serving as the first discharge port; the first valve is disposed on the feeder, and the filling method further comprises:

controlling, by the first valve, a material quantity output from the feeder to the buffer bin.

18. The filling method according to claim 12, wherein the first feed port of the feeding structure is in communication with a supply source, and the filling method further comprises:

conveying a material from the supply source to the first feed port of the feeding structure.

19. The filling method according to claim 12, wherein the filling method further comprises:

discharging the material output from the second discharge port into the electrochemical deposition apparatus.

20. The electrochemical deposition system according to claim 1, wherein the conveying structure comprises:

a conveying pipeline connected between the first discharge port and the second feed port; and a third valve disposed on the conveying pipeline; and wherein the control structure is connected to the third valve and controls the conveying speed of the conveying structure by controlling a degree of opening of the third valve.

* * * * *